US006575395B2

(12) United States Patent
Rodriguez

(10) Patent No.: US 6,575,395 B2
(45) Date of Patent: Jun. 10, 2003

(54) TRACK ASSEMBLY FOR CUTTING TAPE

(75) Inventor: Peter A. Rodriguez, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 09/957,709

(22) Filed: Sep. 19, 2001

(65) Prior Publication Data

US 2003/0052215 A1 Mar. 20, 2003

(51) Int. Cl.[7] ..... B65H 19/26
(52) U.S. Cl. ..... 242/526.2
(58) Field of Search ..... 242/526.2; 83/542

(56) References Cited

U.S. PATENT DOCUMENTS

| | | | | | |
|---|---|---|---|---|---|
| 4,659,029 | A | * | 4/1987 | Rodriguez | 242/526.2 |
| 4,783,018 | A | * | 11/1988 | Rodriguez | 242/526.2 |
| 4,964,584 | A | * | 10/1990 | Taipale et al. | 242/526.2 |
| 5,046,675 | A | * | 9/1991 | Rodriguez | 242/526.2 |
| 5,467,937 | A | * | 11/1995 | Rodriquez et al. | 242/526.2 |
| 6,305,634 | B1 | * | 10/2001 | Rodriguez | 242/526.2 |

* cited by examiner

*Primary Examiner*—John M. Jillions
(74) *Attorney, Agent, or Firm*—Arthur G. Yeager

(57) ABSTRACT

A track and flap assembly includes a brake section and terminates with a curved section and a support member, for guiding a cutting tape transversely across a moving web of paper, and employs a plurality of movable sections enabling relocation of the brake section, and the curved section and its support member without changing their configuration to accommodate different trim widths of the web. The assembly includes a track that has an open channel containing the cutting tape and at least one flap for frictionally engaging the cutting tape when the tape exits laterally from the channel to assist in controlling the tension thereon and its movement. A pair of flaps may extend over a portion of the channel less than the entire width of the channel, and a third flap may overlie and at least cover the space between the pair of flaps forming a complete seal therein. A single flap may form with the channel the top of the guideway for the tape. The pair of flaps may also control the exit direction of the cutting tape from the curved section with one such flap being more pliable and longer than the other. The track includes compressed air or coolant to keep the channel free of contaminants and control its temperature or a liquid coolant to just control its temperature.

26 Claims, 6 Drawing Sheets

TRACK ASSEMBLY FOR CUTTING TAPE

BACKGROUND OF THE INVENTION

1. Field of the Invention

The present invention relates to a track assembly for cutting tape used in turn up operations in the papermaking industry and particularly to a track assembly having removable sections to enable adjustment of the track assembly to different trim widths of paper spools.

2. Related Art

A few track assemblies known in the art are disclosed in Applicant's U.S. Pat. Nos. 4,659,029; 4,783,018; 5,046,675; and Applicant's U.S. application Ser. No. 09/421,702 filed on Oct. 20, 1999, now U.S. Pat. No. 6,305,634 on an improved track and flap assembly for cutting tape. Those track assemblies have a channel through which the tape moves and includes a brake section secured to the channel to frictionally engage the tape to control its movement. The channel terminates with a curved section supported by a supporting member and has a particular configuration for directing a cutting tape to attach to an empty spool. On occasions, the locations of the brake and the curved section with its supporting member need to be adjusted to accommodate for different trim widths of various spools of paper used in the papermaking industry. The trim width of a spool is the distance between a proximate end to a distal end of the spool, which is always less than the length of paper wrapped around the spool. In order to change the locations of the brake and the curved section, the assembly track must be taken apart to relocate the brake section and to move the curved section, and then reassembled. Those actions change the configuration of the curved section and its supporting member, which needs to be readjusted every time for every trim width. Accordingly, there is a need for a track assembly that permits relocation of the brake position and the curved section without changing the configuration of the curved section and its supporting member.

A primary function of the track assembly is to guide a cutting tape transversely across a moving web of paper being wound on a spool and transferring a web onto an empty spool by attaching a tape to an empty spool. In order to control the movement of the cutting tape that exits laterally from the channel, a brake section is used to frictionally engage the tape to reduce its speed. Applicant's U.S. Pat. No. 6,305,634 provides a track and flap assembly that includes a compressible means or a foam material extending transversely over the channel to provide a controlled resistance against the cutting tape exiting to assist in control of the tape spooling on an empty spool. A plurality of flap members can be positioned between the foam material and the channel to provide for additional friction when the tape exits the channel. However, the occasional frictional wear between the foam block and the flap members is an undesirable effect. Accordingly, there is a need for a controlled resistance of the tape that has less frictional wear.

Additionally, the channel often gets contaminated from the surrounding environment. In order to prevent contamination, Applicant's U.S. Pat. No. 6,305,634 provides a track and flap assembly that includes an air hose that directs air via passageway into the channel to inhibit contamination since contaminants may adversely affect the introduction of the tape through the guideway or channel, particularly since the adhesive is applied to the cutting tape and slides with its bottom adjacent the contact surface of the guideway picking up debris with the adhesive that adversely affects its adherence to the empty spool. However, air wasn't provided throughout the entire track by the air hose. Accordingly, there is a need for a method for supplying air throughout the entire track to keep the track free from contaminants.

Furthermore, the channel often becomes heated due to the ambient condition of the location of the turn-up assembly adjacent the heated drier end of the paper making machines, these could be a pulper located beneath the paper reel and steam is added to such pulper causing increased heat and humidity and creating additional problems for the cutting tape traveling through the guideway. The prior art does not disclose or suggest a method for controlling the temperature of the channel. Accordingly, there is a need for a method for controlling the temperature of the channel.

The present invention provides for removable sections of the track, including brake means section, to enable addition, deletion or relocation of the brake means with respect to any variable trim width of a paper spool, and to enable relocation of the curved section and the supporting member along the track without changing their configuration.

The present invention also provides for a controlled resistance against the cutting tape through a single flap, double or triple flaps mounted on top of the channel to engage the tape when laterally exiting from the channel. Customizing of the frictional brake effect of the flaps may be achieved which are primarily dictated by machine speed, grade and calipers of the web.

Another embodiment of the present invention provides for a plurality of compressible means or flap members covering different portions of the channel. One flap member is secured to one side of the channel extending over a portion of the channel substantially less than the width of the channel. Another flap member is secured to the other side of the channel directly opposite from the one flap member and covering less than a substantial width of the channel without touching the other flap to minimize frictional wear between them. In order to provide for an enlarged seal of the channel to inhibit entry of contaminants into the channel from the surrounding environment and to assist in controlling the lateral movement of the cutting tape, a third flap member is secured to one side of the channel juxtaposed to and on top of the one flap member and extending substantially over the channel forming a complete seal therein.

The present invention provides a method for keeping the channel free from contaminants from the surroundings by supplying air to the entire channel by a plurality of air passages throughout the entire track located below the upper portion of the track and a respective number of passageways to fluidly communicate between the air passages and the channel. The distribution of air throughout the entire track by the air passages helps keep the cutting tape afloat by the positive pressure of the supplied air and thereby reducing friction between the tape and the channel.

A coolant can be pumped through the passages to help control the temperature of the channel, which is heated by the ambient conditions of the location of the turn-up assembly.

It is an object of the present invention to provide for a track assembly having a readily movable and adjustable brake section.

It is another object of the present invention to provide for a track assembly having readily movable and adjustable curved section and its supporting member that maintain their configuration.

It is another object of the present invention to provide for a track assembly having adjustable and movable brake and curved sections to accommodate for different web trim widths.

Still, it is a further object of the present invention to provide for a track assembly having flap means covering different portions of the channel to assist in controlling a tape exiting laterally from the channel.

It is a related object of the present invention to provide for a track assembly having a single flap member extending substantially over the channel to provide for frictional engagement with the tape.

It is a further object of the present invention to provide for a track assembly having a track including upper and lower portions and having a channel in the upper portion through-which a cutting tape moves, a plurality of spaced elongated air passages through the entire track located below the upper portion, a plurality of spaced passageways communicating fluidly between the passages and the channel for receiving compressed air to control the temperature of the channel and to keep the channel clean from contaminants.

Yet, it is another object of the present invention to provide for a track having an upper portion and having coolant passage located below the upper portion of the track for receiving a coolant at a lower temperature than the channel to control the temperature of the channel, which is frictionally heated by a cutting tape passing therethrough. Still other objects of the present invention will become apparent from the more detailed description that follows.

BRIEF SUMMARY OF THE INVENTION

The present invention relates to an improved track assembly for guiding a cutting tape transversely across a moving web of paper being wound on a spool and transferring the cut web to an empty spool. The assembly includes an elongated fixed track support extending beyond the edge of a web and an elongated track having opposite ends adjacent side edges of a moving web for receiving a cutting tape into one open end and exiting out of the other open end. The track has upper and lower portions and a longitudinal channel or guideway formed in the upper portion through-which the cutting tape moves. Flap means including, in one embodiment of the present invention first and second elongated flap means, each being fastened to one side of the upper portion directly opposite from each other and extending toward each other, covering a portion of the channel. A third elongated flap means extends substantially over the channel and is disposed on top of the first and second flap means to form a complete seal therewith to assist in controlling the cutting tape exiting laterally from the channel to attach to an empty spool.

The flap means can be selected to increase or decrease tension in the cutting tape as it is being pulled out from the track. For example, varying the space covered by the flap means over the open channel may vary such tension, but debris is more likely to enter. Also, varying the pliability of the flap means changes the tension. The position of the flap means can also be selected so that more or less tension is applied at different portions along the track. The present invention provides softer flap means than the guideway of the prior art and as a consequence the flap means do not damage the edges of the cutting tape as it is being pulled out of the guideway. The track further includes a track carrier that has an elongated hollow and an upper portion for carrying the track. The track carrier is mounted on the elongated fixed support extending through the hollow.

Another embodiment of the present invention further includes a curved section positioned at the other open end of the track having a configuration for inverting the cutting tape to position an adhesive carried by the cutting tape upwardly and to be fed to a nip formed between the empty spool and a web driving spool, and supporting member for supporting the curved section and is slidably movable along the support. The curved section typically includes a pair of elongated flap means extending over the guideway to control the exit of the cutting tape. The exit direction of the tape can be controlled by making one flap means more pliable and longer than the other flap means, thereby permitting the cutting tape to exit laterally adjacent the less pliable flap means. The track also includes a brake means section detachably mounted on the track for frictionally engaging the tape. The track having a plurality of movable sections in proximity with the brake means section enabling addition, deletion or relocation of these sections to relocate the brake means section, the curved section and the supporting member without changing the configuration of the curved section and the supporting member to adjust for different trim widths of webs.

In a further embodiment in accord with the present invention, the track includes a plurality of spaced elongated air passages located below the upper portion of the track and a plurality of spaced passageways communicating fluidly between the air passages and the channel for receiving compressed air to inhibit entry into the channel of contaminants from the surrounding environment and to control the temperature of the channel.

In an alternative embodiment of the present invention, the track includes coolant passages located below the upper portion of the track for receiving coolant at a lower temperature than the channel to control the temperature of the channel.

An alternative embodiment of the present invention has a single flap means fastened to one side of the upper portion and substantially extending over the channel to frictionally engage the tape when it exits transversely from the channel.

BRIEF DESCRIPTION OF THE DRAWINGS

The novel features believed to be characteristic of the present invention are set forth with particularity in the appended claims. The present invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
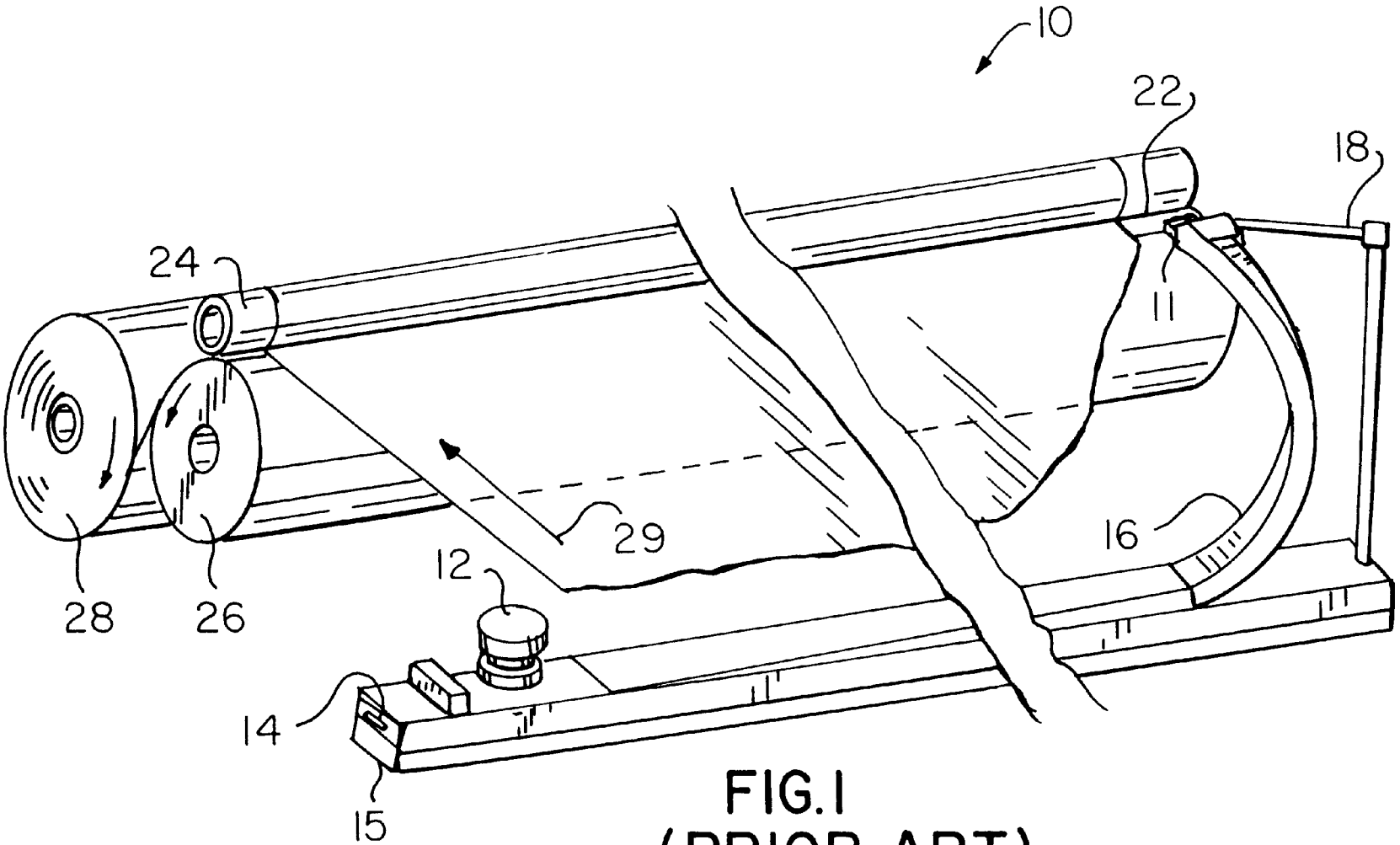
FIG. 1 (PRIOR ART)
FIG. 1 is an isometric view of a prior art track assembly.

FIG. 1 shows a prior art apparatus 10 used in the paper industry to cut a moving web of paper 29 being wound up on a spool 28 and to transfer the cut edge of the paper to an empty wind up spool 24 without having to stop the paper movement. In order to cut the moving paper web 29 and start it winding onto the empty spool 24, a cutting tape 11, not shown, is moved forward and is caught in the nip 22 formed between the web driving spool 26 and the empty spool 24. The tape 11 is wrapped helically around the spool 28 and in so doing it cuts through the paper web 29 and leads the cut edge onto the empty spool 24, which continues to wind up the web 29 until it is full and the entire operation is repeated to cut and transfer the web to a new, empty wind up spool. Soon after, the web 29 is transferred to the spool 24, the spool 28 is moved away from the drive spool 26 and a new empty spool is moved down to the previous position of the full spool 28.

The tape 11, which is introduced into the track 14 is directed to a dispensing section, not shown, where it is treated to apply a coating pressure sensitive adhesive to the forward portion of the tape 11. The tape 11 is then cut into a finite length and pushed along until the tape 11 is at the end of the curved section 16. The tape 11 is then stopped and held in position until an operator decides it is time to cut and transfer the web 29 to a new spool. In order to cut the web 29 properly, it is crucial that the cutting tape 11 be tensioned enough to cut the paper web 29 and not merely pulled. However, the prior art generally, except Applicant's U.S. Pat. No. 6,305,634, lacks any means to control the tension in the cutting tape after exiting from the brake section 12 and until attaching to the nip 22 formed between a web driving spool 26 and an empty spool 24.

Another problem with the prior art results from contact of the tensioned tape 11 with the channel 15 in which the tape 11 passes through. A further problem with the prior art is the need to adjust the entire track assembly 10 including the position of the brake section 12 and the configuration of the curved section 16 for every different trim width for various paper webs used in the paper making industry. The present invention discloses an improved track assembly designed to overcome these and other problems with the prior art.

Figure 2:
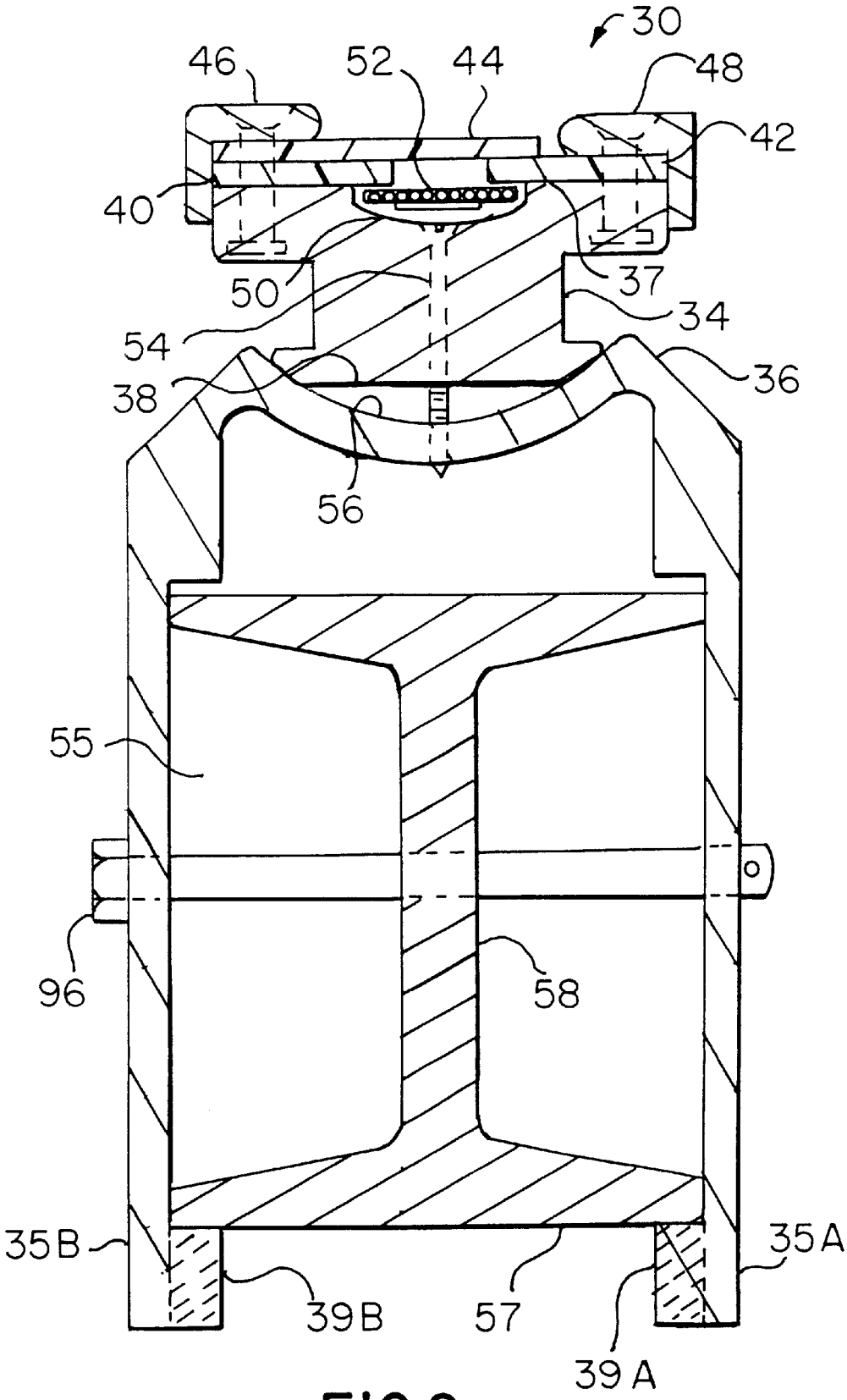
FIG. 2 is a cross section of the track assembly showing three flap means extending over a channel containing a tape inside to frictionally engage the tape and to keep the channel clean from contaminants.

FIG. 2 shows the track assembly 30 of the present invention and includes a track 34, which is generally an H-shaped structure and has an upper portion 37 wherein a channel 50 is formed that functions as a guideway for the cutting tape 52. The track 34 has a lower portion 38 that rests on a track carrier 36. The upper portion 56 of the carrier 36 is generally of a concave shape and abuts the lower portion 38 of the track 34. The track 34 and the carrier 36 are secured together via spaced fasteners in the form of self-threading screws, or bolts and nuts, or the like that pass through the track 34 and the upper portion of the track carrier 36. The track carrier 36 has a hollow inside 55 that has a complimentary shape to the upper portion 56 and lower portion 57 of an elongated fixed support or generally an I-beam shaped support 58. The track carrier 36 has two supporting legs 35A and 35B and respective two lower portions 39A and 39B that extend beneath the lower portion 57 of the fixed support 58. The track carrier 36 is fastened to the elongated fixed support 58 by an air craft pin 96, which is a pull pin. In order to slide the carrier 36, which carries the track 34, along the elongated fixed support 58, the pin 96 has to be pulled out to disengage the carrier 36 from the fixed support 58.

The track assembly 30 of the present invention further includes a plurality of flap means, a first flap means 40, a second flap means 42 and a third flap means 44. The first flap means 40 is secured to one side of the channel 50, which is formed in the upper portion 37 of the track 34, by a fastener or a clamp 46. The first flap means 40 extends over a portion of the cutting tape 52 less than a substantial portion to avoid frictional contact between the first flap means 40 and the second flap means 42. The second flap means 42 is positioned directly opposite from the first flap means 40 and secured to another side of the upper portion 37 of the track 34 by a fastener or a clamp 48. The first and second flap means, 40 and 42, frictionally engage the cutting tape 52 to assist in controlling the movement of tape 52 and to tension the tape 52 enough to cut a paper web properly. The third flap means 44 forms a complete seal with the first and second flap means 40 and 42 to keep clean the adhesive placed on the tape 52 free from contaminants and debris from the surrounding industrial environment and to prevent build up of debris inside the channel 50. The first flap means 40 and the second flap means 42 are preferably more pliable than the third flap means 44 to enable two different controlled resistances for controlling the exiting of the cutting tape 52 from the channel 50 and to provide for stiffer surface resistance as the tape 52 exits the channel 50.

Figure 3:
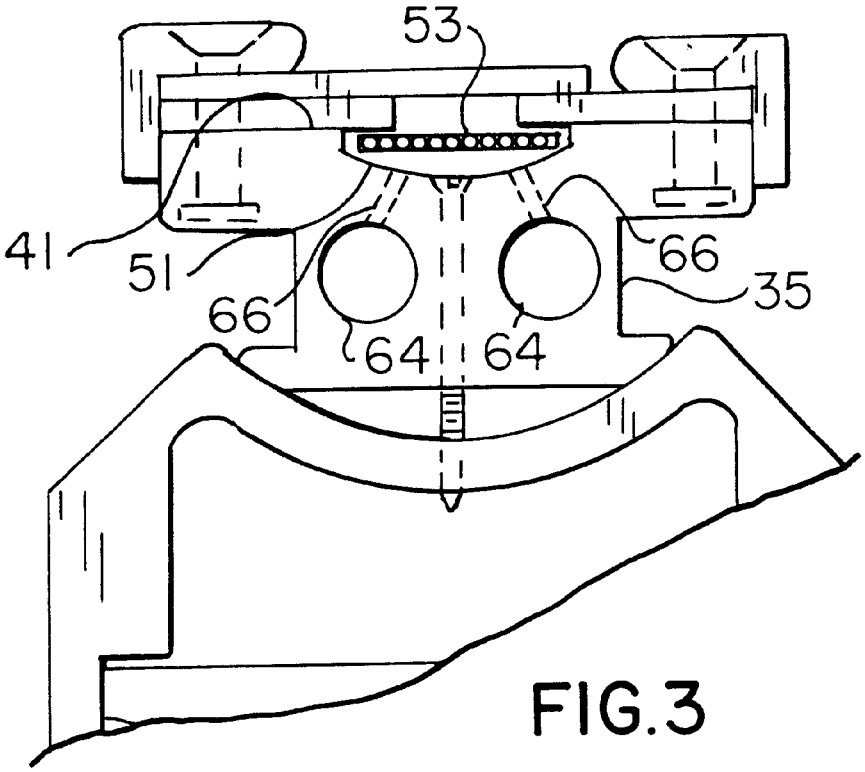
FIG. 3 is a cross section of a further embodiment of FIG. 2 including a plurality of air passages located below the upper portion and a plurality of respective passageways communicating fluidly between the air passages and the channel.

FIG. 3 shows a further embodiment in accord with the present invention that includes a plurality of elongated air passages means 64 extending throughout the entire track 35 and positioned below the upper portion 41 of the track 35 for receiving compressed air from an air source, not shown, to distribute air through the passageways 66 to inhibit entry into the channel 51 of contaminants from the surrounding environment. Cold air can be supplied throughout air passageways 66 to help keep the tape 53 afloat and minimize contact between the tape 53 and the channel 51 and thereby control the temperature of the channel 51 due to the frictional contact with the tape 53.

Figure 4:
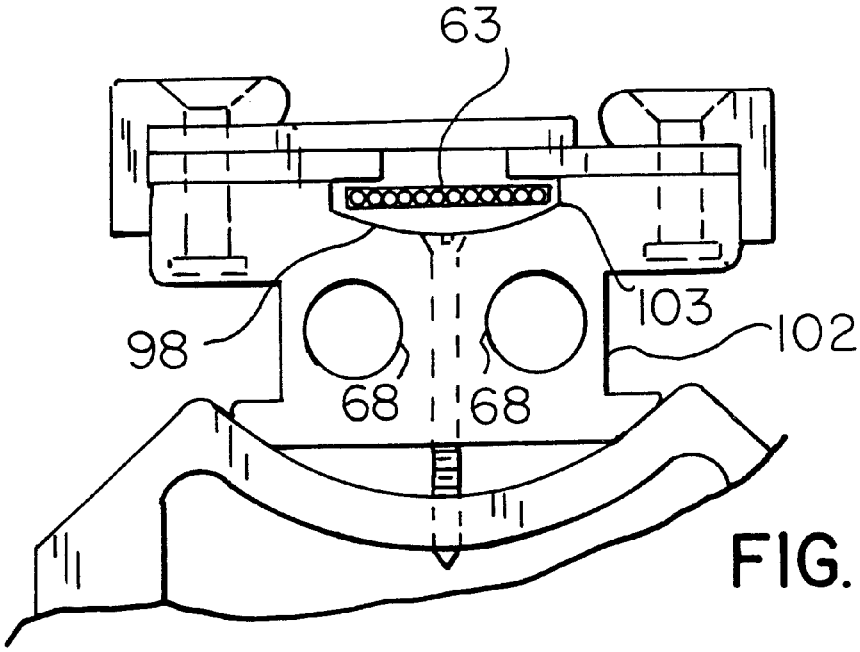
FIG. 4 is a cross section of another embodiment of FIG. 2 including a plurality of coolant passages located below the upper portion of the track.

FIG. 4 shows an alternative embodiment in accord with the present invention that includes a plurality of coolant passages 68 extending through the entire track 102 and receiving a coolant from a cold source, not shown, and positioned beneath the upper portion 103 of the track 102 to control the temperature of the channel 98, which is frictionally heated by the tape 63 passing therethrough.

Figure 5:
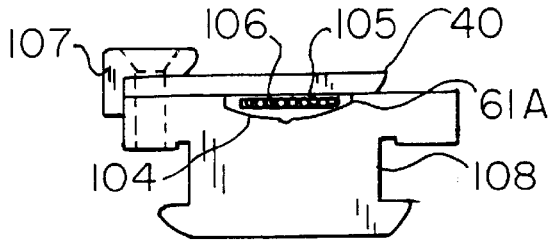
FIG. 5 shows a cross section of an alternative embodiment of the track including a single flap means in accord with the present invention.

An alternative embodiment of the present invention is shown in FIG. 5 and includes a single flap means 105 fastened to one side of the track 108 by a fastener or a clamp 107. The flap means 105 extends substantially over the channel 104 frictionally engaging the tape 106 to assist in tensioning the tape 106 and controlling its movement when it exits laterally from the channel 104. The flap means 105 forms a complete seal to help protect the adhesive placed on the forward end of the tape 106 by an adhesive station, not shown, as illustrated in Applicant's numerous above-identified U.S. patents, from contaminants in the surrounding paper making industry environment and to prevent a build up of debris, from the surroundings, inside the channel 104.

Figure 6:
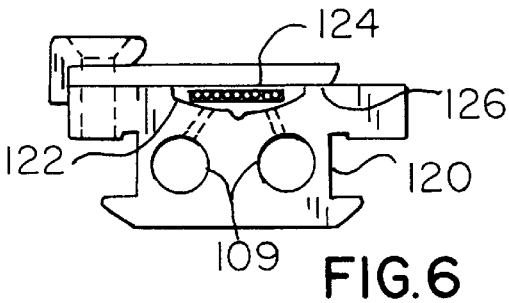
FIG. 6 shows a cross section of a further embodiment of FIG. 5 including a plurality of air passages communicating fluidly with respective air passageways to distribute air to the channel.

FIG. 6 shows a track 120 provided with a plurality of elongated spaced air passages 109 extending through the entire track 120. The track 120 includes air passages to distribute air into the channel 122 beneath the tape 124 to control the temperature of the tape 124 and keep it clean from contaminants.

Figure 7:
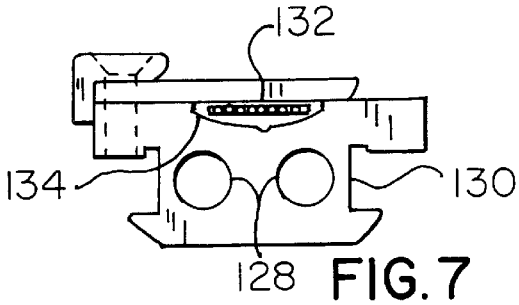
FIG. 7 shows a cross section of a further embodiment of the track of the present invention including a plurality of coolant passages located below the upper portion of the track to cool the channel.

FIG. 7 shows another embodiment of the present invention that includes a plurality of coolant passages 128 extending through the entire track 130 to control the temperature of the tape 132.

Figure 8A:
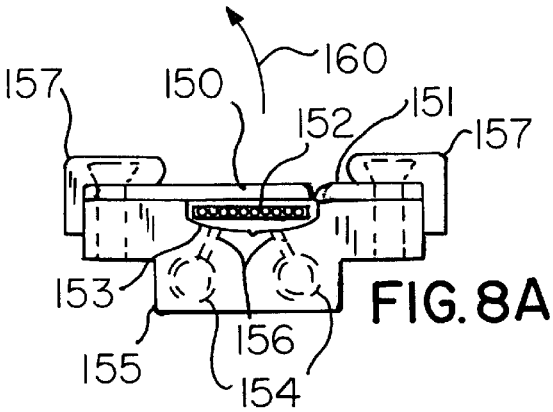
FIG. 8A shows a cross section of another embodiment of the curved section.
Figure 8:
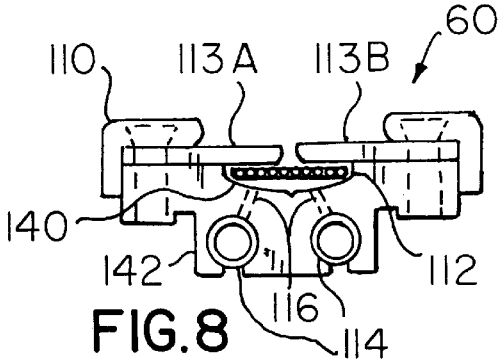
FIG. 8 shows a cross section of the curved section, which is located at a distal end of the track assembly of the present invention.

FIG. 8 shows a curved section 60, which includes a first flap means 113A and a second flap means 113B positioned directly opposite from each other and that extend substantially over a guideway 112 through which the tape 140 passes. The flap means 113A and B frictionally engage the tape 140 to assist in controlling its tension and speed when the tape 140 exits the curved section 60 to pass into the nip formed between an empty spool and a web driving spool and attaches to the empty spool by way of adhesive applied to the forward end of the cutting tape, as Applicant disclosed in his above-identified U.S. patents. The flap means 113A and B extend laterally toward each other to cover the guideway 112 and seal against contaminants. The flaps 113A and B are secured to the track 142 by a fastener or a clamp 110. A plurality of elongated air passages 114 and passageways 116 extend through the entire track 142 to keep the guideway 112 clean from any contaminants that may affect the adhesive disposed on the tape 140 to attach to the empty spool or cause a build up in the guideway 112 that may interfere with the movement of the tape 140. Alternatively, a coolant can be pumped into the passages 114, without the need to use the passageways 116, to cool the guideway 112 and the tape 140. It may be desirable for a light web using a thin cutting tape to make other portions of the track beneath the web of the configuration shown in FIGS. 8 and 8A.

FIG. 8A shows another embodiment of the curved section 60 in accord with the present invention having a pair of flaps 150 and 151 secured to the track 155 by a pair of fasteners or clamps 157. The pair of the flaps 150 and 151 are designed to control the exit direction shown by arrow 160 of the cutting tape 152 from the guideway 153. The flap 150 is made more pliable and longer than the other flap 151 in order to force the cutting tape 152 to laterally exit adjacent the more pliable and longer flap 150.

Figure 9:
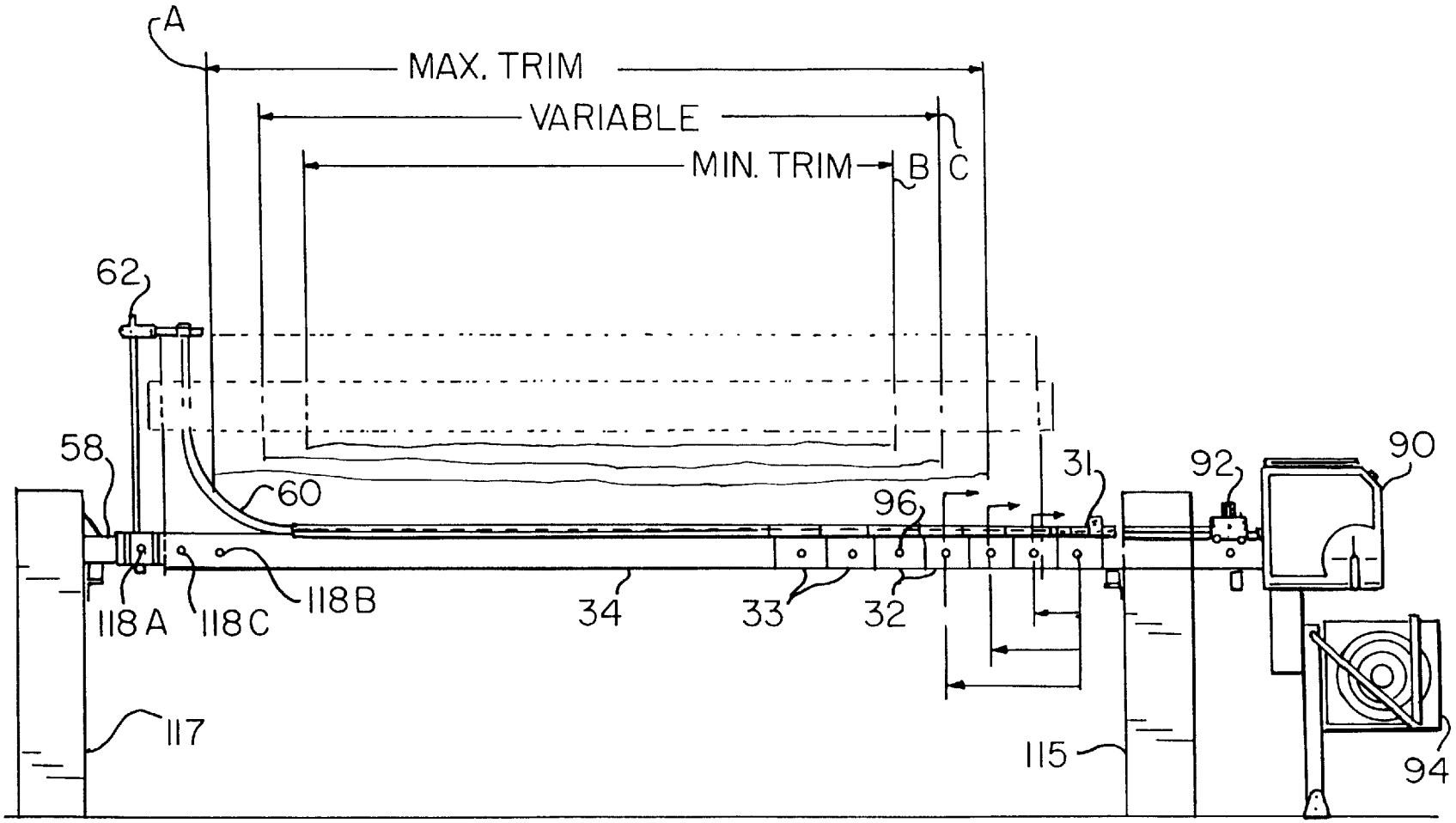
FIG. 9 is a side view of the track assembly including removable track sections to accommodate different trim widths of webs and a movable brake means section and adjustable and movable curved section along with its support member in accord with the present invention.

A side view of a track assembly embodiment of the present invention is shown in FIG. 9. The track 34 has a plurality of removable sections 32 located in proximity with the brake section 31, located adjacent a tape dispensing system 90 that includes an adhesive station 92 and a supply spool 94 disposed beneath it, not part of the present invention. The track 34 terminates with a curved section 60 secured to a supporting member 62, which are slidably movable on the elongated fixed support 58 carried by the structural support members 115 and 117. In order to slide the curved section 60 and the supporting member 62 on the track 34, a pin occupying hole 118A, which is a pull pin, must be pulled out in order to slide the curved section 60 and the supporting member 62 along the track 34 to either position 118B or C according to the desired trim width and thereafter insert the pin into either hole 118B or C in order to secure them to the track 34.

Each of the removable sections 32 is coupled to the track 34 via a removable air craft pin 96, which is a pull pin. In order to disengage any of sections 32 from the track 34, the pin 96 is pulled out and the desired section is simply lifted off the track 34. This can readily be accomplished since the lower portions 39A and 39B of the track carrier 36 were machined off to enable separation of sections 32 and the brake section 31 from the elongated fixed support 58.

Figure 10:
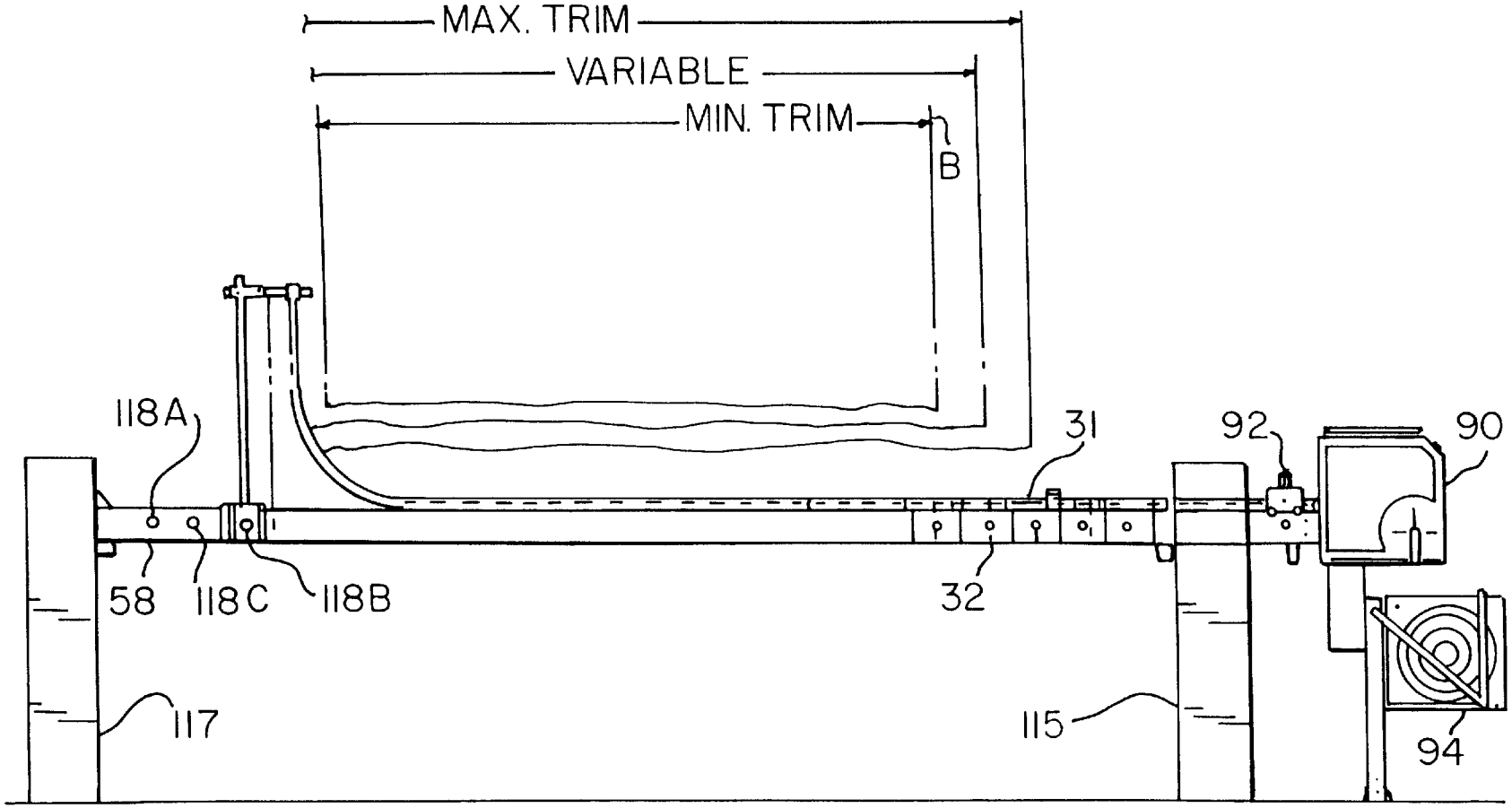
FIG. 10 illustrates the movement of the brake means section from a maximum trim width to a minimum trim width and the relocation of the curved section and its supporting member with their configuration intact in accord with the present invention.

The removability of section 32 enables changing the positions of the brake section 31 and the curved section 60 and its supporting member 62 to accommodate for different trim widths, a maximum trim designated as A, a variable trim width C and a minimum trim width B, without changing the configuration of these parts. For example, in order to move the brake section 31 from a maximum trim position A to a minimum trim position B, two sections 33 must be taken out and other movable sections must be relocated so that brake section 31 occupies its proper position relative to the minimum trim width B, as shown in FIG. 10. The curved section 60 and its supporting member 62, are then moved by pulling out the pin from hole 118A and sliding them on the elongated fixed support 58 to their new proper position relative to the minimum trim width B without changing their configurations, as shown in FIG. 10, and then securing them to the track 34 by inserting the pin in hole 118B.

Likewise, the brake section 31 and the curved section 60 and its supporting member 62 can be relocated to any of the desired trim widths without changing their configurations.

While the invention has been described with respect to certain specific embodiments, it will be appreciated that many modifications and changes may be made by those skilled in the art without departing from the spirit of the invention. It is intended, therefore, by the appended claims to cover all such modifications and changes as they fall within the true spirit and scope of the invention.

What is claimed as new and what is desired to secure by Letters Patent of the United States is:

1. A track assembly for guiding a cutting tape transversely across a moving web of paper being wound on a spool and transferring a web onto an empty spool by attaching a tape to an empty spool, said track assembly comprising an elongated fixed support extending beyond edges of a web, an elongated track having opposite open ends adjacent side edges of a moving web for receiving a cutting tape into one said open end and exiting out of another said open end, said track having an upper portion and a lower portion and a longitudinal channel formed in said upper portion through which a cutting tape moves, flap means to assist in controlling a cutting tape exiting laterally from said channel to attach to an empty spool, said flap means including first and second elongated flap means each being fastened to respective sides of said upper portion directly opposite from each other and extending toward each other over a portion of said channel, and third elongated flap means extending substantially over said channel and being fastened along one side of said channel, said third flap means being disposed on top of said first and second flap means to form a complete seal therewith of said open side of said channel.

2. The track assembly of claim 1 wherein said third flap means having a different pliability than said first and second flap means.

3. The track assembly of claim 1 wherein said track includes a plurality of spaced elongated passages below said upper portion, a plurality of spaced passageways communicating fluidly between respective said passages and said channel for receiving compressed air to inhibit entry into said channel of contaminants from the surrounding environment and to reduce temperature of said channel.

4. The track assembly of claim 1 wherein said track includes coolant passages below said upper portion for receiving coolant at a lower temperature than said channel.

5. The track assembly of claim 4 wherein said track includes a plurality of spaced passageways between respective said passages and said channel, and wherein the coolant is compressed air for temperature reduction of said channel and inhibiting entry of contaminants into said channel.

6. The track assembly of claim 1 further including a track carrier having an elongated hollow and an upper portion, said track being supported on said upper portion, said track carrier being mounted on said elongated fixed support extending through said hollow.

7. The track assembly of claim 1 wherein said track further includes brake means section mounted on said track for frictionally engaging a tape, and said track further includes a plurality of movable sections in proximity with said brake means section enabling addition, deletion or relocation of said sections to relocate said brake means to adjust for different trim widths of webs.

8. The track assembly of claim 1 further including a plurality of removable sections adjacent said one open end to accommodate different trim widths.

9. The track assembly of claim 8 further including a curved section having an upper portion and a lower portion and positioned at said another open end of said track having a configuration for inverting a cutting tape passing therethrough to position an adhesive carried by a cutting tape upwardly and to be fed to a nip formed between an empty spool and a web driving spool, a supporting member for supporting said curved section, and said curved section and said supporting member being movable and adjustable for different trim widths without changing their configuration.

10. The track assembly of claim 1 further including a curved section having an upper portion and a lower portion and positioned at said another open end of said track having a configuration for inverting a cutting tape passing therethrough to position an adhesive carried by a cutting tape upwardly and to be fed to a nip formed between an empty spool and a web driving spool, a supporting member for supporting said curved section, said curved section having first and second elongated flap means each being fastened to one side of said upper portion of said curved section directly opposite from each other and extending toward each other substantially over said channel.

11. The track assembly of claim 10 wherein said curved section and supporting member being movable along said elongated fixed support without changing the configuration of said curved section and said supporting member to adjust for different trim widths of webs by addition, deletion or relocation of said track sections.

12. A track assembly for guiding a cutting tape transversely across a moving web of paper being wound on a spool and transferring a web onto an empty spool by attaching a tape to an empty spool, said track assembly comprising an elongated fixed support extending beyond edges of a web, an elongated track having opposite open ends adjacent side edges of a moving web for receiving a cutting tape into one said open end and exiting out of another said open end, said track having an upper portion and a lower portion and a longitudinal channel formed in said upper portion and having at least a partially open side through which a cutting tape moves, and said track having a plurality of movable sections adjacent said one open end enabling addition, deletion or relocation of said sections to adjust for different trim widths of webs.

13. The track assembly of claim 12 further including brake means section mounted on said track and adjacent said movable section for frictionally engaging a tape, and said brake section being movable to accommodate different trim widths of webs.

14. The track assembly of claim 12 further including first and second elongated flap means each being fastened to one side of said upper portion directly opposite from each other and extending toward each other over a portion of said channel, and third elongated flap means extending substantially over said channel and being fastened along one side of said channel, said third flap means being disposed on top of said first and second flap means to form a complete seal therewith of said open side.

15. The track assembly of claim 12 further including a single elongated flap being fastened to one side of said upper portion and substantially extending over said channel form a complete seal of said open side.

16. The track assembly of claim 12 wherein said track includes a plurality of spaced air passages below said upper portion, a plurality of spaced air passageways communicating fluidly between respective said passages and said channel for receiving compressed air to inhibit entry into said channel of contaminants from the surrounding environment and to control the temperature of said channel.

17. The track assembly of claim 12 wherein said track includes coolant passages below said upper portion for receiving coolant at a lower temperature than said channel.

18. The track assembly of claim 12 further including a curved section having an upper portion and a lower portion and positioned at said another open end of said track having a configuration for inverting a cutting tape passing therethrough to position an adhesive carried by a cutting tape upwardly and to be fed to a nip formed between an empty spool and a web driving spool, a supporting member for supporting said curved section, said curved section having first and second elongated flap means each being fastened to one side of said upper portion of said curved section directly opposite from each other and extending toward each other substantially over said channel.

19. The track assembly of claim 12 further including a track carrier having an elongated hollow and an upper portion, said track being supported on said upper portion, said track carrier being mounted on said elongated fixed support extending through said hollow.

20. A track assembly for guiding a cutting tape transversely across a moving web of paper being wound on a spool and transferring a web onto an empty spool by attaching a tape to an empty spool, said track assembly comprising an elongated fixed support extending beyond edges of a web, an elongated track having opposite open ends adjacent side edges of a traveling web for receiving a cutting tape into one said open end and exiting out of another said open end, said track having an upper portion and a lower portion and a longitudinal channel formed in said upper portion and having at least partially open side through which a cutting tape moves, a curved section positioned at said another open end of said track having a configuration for inverting a cutting tape to position an adhesive carried by a cutting tape upwardly and to be fed to a nip formed between an empty spool and a web driving spool, a supporting member for supporting said curved section, said curved section and supporting member being slidably movable along said support, said track having a plurality of movable sections in proximity with said one open end enabling addition, deletion or relocation of said sections to relocate said curved section and said supporting member without changing their configuration to adjust for different trim widths of webs.

21. The track assembly of claim 20 further including brake means section adjacent said one open end, said brake section being movable to accommodate for different trim widths of webs.

22. The track assembly of claim 20 further including flap means to assist in controlling a cutting tape exiting laterally from said channel to attach to an empty spool.

23. The track assembly of claim 20 wherein said track includes a plurality of spaced elongated passages below said upper portion, a plurality of spaced passageways communicating fluidly between respective said passages and said channel for receiving compressed air to inhibit entry into said channel of contaminants from the surrounding environment.

24. The track assembly of claim 20 further including a track carrier having an elongated hollow and an upper portion, said track being supported on said upper portion, said track carrier being mounted on said elongated fixed support extending through said hollow.

25. The track assembly of claim 20 further including first and second elongated flap means each being fastened to one side of said upper portion directly opposite from each other and extending toward each other over a portion of said channel, and third elongated flap means extending substantially over said channel and being fastened along one side of said channel, said third flap means being disposed on top of said first and second flap means to form a complete seal therewith of said open side.

26. The track assembly of claim 20 further including a single elongated flap being fastened to one side of said upper portion and substantially extending over said channel form a complete seal of said open side.

* * * * *